US005209535A

United States Patent [19]

Bergeron

[11] Patent Number: 5,209,535

[45] Date of Patent: May 11, 1993

[54] POWER BUCKET

[76] Inventor: Raymond E. Bergeron, 3452 W. Jefferson, Trenton, Mich. 48183

[21] Appl. No.: 761,274

[22] Filed: Sep. 17, 1991

[51] Int. Cl.[5] ..... B66C 3/02

[52] U.S. Cl. ..... 294/68.23; 294/111; 37/184

[58] Field of Search ..... 294/68.23, 111; 37/183 R, 184, 185, 186, 187, 188

[56] References Cited

U.S. PATENT DOCUMENTS

| | | | |
|---|---|---|---|
| 424,571 | 4/1990 | Pay . | |
| 1,298,340 | 3/1919 | Hatt . | |
| 1,444,800 | 2/1923 | Mellin . | |
| 2,032,378 | 3/1936 | Rice, Jr. | 294/68.23 X |
| 2,049,679 | 8/1936 | Whiteman et al. . | |
| 3,036,393 | 5/1962 | Baird, Jr. | 294/68.23 X |
| 4,127,298 | 11/1978 | Egholm | 294/68.23 X |
| 4,143,901 | 3/1979 | van Huuksloot . | |
| 4,327,943 | 5/1982 | Longo . | |
| 4,395,066 | 7/1983 | van Huuksloot . | |
| 4,538,848 | 9/1985 | Aberkrom . | |
| 4,998,762 | 3/1991 | Bergeron . | |
| 5,029,923 | 7/1991 | Bergeron . | |

FOREIGN PATENT DOCUMENTS

| | | | |
|---|---|---|---|
| 435203 | 10/1926 | Fed. Rep. of Germany | 294/68.23 |
| 1353008 | 1/1964 | France . | |
| 253803 | 2/1988 | German Democratic Rep. . | |
| 704884 | 12/1979 | U.S.S.R. . | |
| 1344723 | 10/1987 | U.S.S.R. . | |
| 1364596 | 1/1988 | U.S.S.R. . | |
| 1435528 | 11/1988 | U.S.S.R. . | |
| 9012750 | 11/1990 | World Int. Prop. O. | 294/68.23 |

*Primary Examiner*—Johnny D. Cherry
*Assistant Examiner*—Joseph D. Pape
*Attorney, Agent, or Firm*—Gifford, Groh, Sprinkle, Patmore and Anderson

[57] ABSTRACT

A power bucket for loading and unloading cargo. The bucket includes a first and second bucket half wherein each bucket half has a top, a closed bottom, an open inside end and a pair of spaced apart sidewalls. The buckets are pivotally secured together at their top by two spaced apart trunnions so that the bucket halves are movable between an open and a closed position. A head is disposed above the bucket while at least one cable extends between the head and each bucket half. A closure cable extends around at least one pulley rotatably mounted to one bucket half and is secured to the other bucket half for moving the bucket halves between an open and a closed position. This closure cable also extends through a guide loop attached to the head.

7 Claims, 2 Drawing Sheets

POWER BUCKET

BACKGROUND OF THE INVENTION

I. Field of the Invention

The present invention relates to power buckets or grabs for loading and unloading cargo.

II. Description of the Prior Art

The previously known clam shell buckets of the type used with power shovels typically comprise a pair of bucket halves which are pivotally secured together adjacent to their upper end. The upper end of the bucket is also known as the bucket "head" and this head is connected by a cable to a power mechanism which raises and lowers the bucket. Additionally, a closure cable is secured to the bucket halves for moving the bucket halves between their open and closed positions.

A primary disadvantage of these previously known buckets is that the buckets are made of a cast construction. The cast construction is not only expensive to manufacture but also significantly increases the overall weight of the bucket. This, in turn, reduces the overall cargo capacity of the bucket since the capacity of the power shovel is determined not only by the weight of the cargo within the bucket, but also the weight of the bucket itself. For example, if the power winch for raising the bucket is capable of lifting fifteen tons and the bucket itself weighs five tons, then only ten tons of cargo can be lifted by the power shovel.

One reason for the excessive weight of these previously known grabs or buckets is that the head is cast as a one piece construction with at least one of the bucket halves so that the extra metal between the head and the bucket half significantly increases the overall weight of the bucket. Additionally, a cast construction is typically relatively thick which also increases the overall weight of the bucket.

In order to overcome some of the above described disadvantages of the previously known clam shell buckets, there are a number of previously known buckets which have a head disposed above a pair of bucket halves. The bucket halves are in turn pivotally mounted together and suspended from the head by elongated cables. Examples of such buckets are disclosed in my prior U.S. Pat. Nos. 4,998,762 and 5,029,923.

In these previously known power buckets of the type in which the bucket halves are suspended from the head by cables, the bucket halves are typically pivotally secured together by an elongated tubular shaft extending through registering journals on the bucket halves. This construction, however, has not proven wholly satisfactory in operation.

One disadvantage of this previously known construction is that the shaft as well as the registering journals formed in the bucket halves are relatively expensive not only in material costs, but also in labor in order to construct the pivot shaft with its associated journals. Furthermore, any misalignment of the pivot shaft with its journals will rapidly result in excessive wear and necessitate expensive repairs for the bucket.

A still further disadvantage of this previously known type of bucket is that disassembly of the bucket halves for repair or other reasons is not only difficult but, in many cases, impossible without destruction of the pivot shaft.

A still further disadvantage of these previously known power buckets is that the closure cable was unattached with respect to the head. As such, the closure cable was prone to wild swings during operation of the bucket. Such wild swings of the closure cable not only creates a safety hazard, but can also damage the cable as well as the head.

SUMMARY OF THE PRESENT INVENTION

The present invention provides a bucket for a power shovel which overcomes all of the above mentioned disadvantages of the previously known devices.

In brief, the bucket of the present invention comprises a first bucket half and a second bucket half wherein each bucket half has a top, a closed bottom, spaced apart sidewalls and an inside end. The bucket halves are pivotally secured at their upper ends so that the bucket halves are movable between an open and a closed position. Unlike the previously known buckets, however, the bucket of the present invention uses a pair of spaced apart trunnions as the pivotal connection between the bucket halves thereby eliminating the previously known difficulties with the previously known pivot shafts.

A head is also positioned above the bucket halves and is connected to each bucket half by at least one cable. The head, in turn, is connected to the lifting cable for the power shovel.

A guide loop is also formed on the head and a closure cable extends through the guide loop toward the bucket halves. Thus, the guide loop prevents swinging of the closure cable during operation of the power bucket.

The lower end of the closure cable is wound around at least one, and preferably several, pulleys rotatably mounted to the bucket halves and the free end of the closure cable is secured to one of the bucket halves. Thus, movement of the closure cable relative to the head moves the bucket halves between their open and their closed position.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
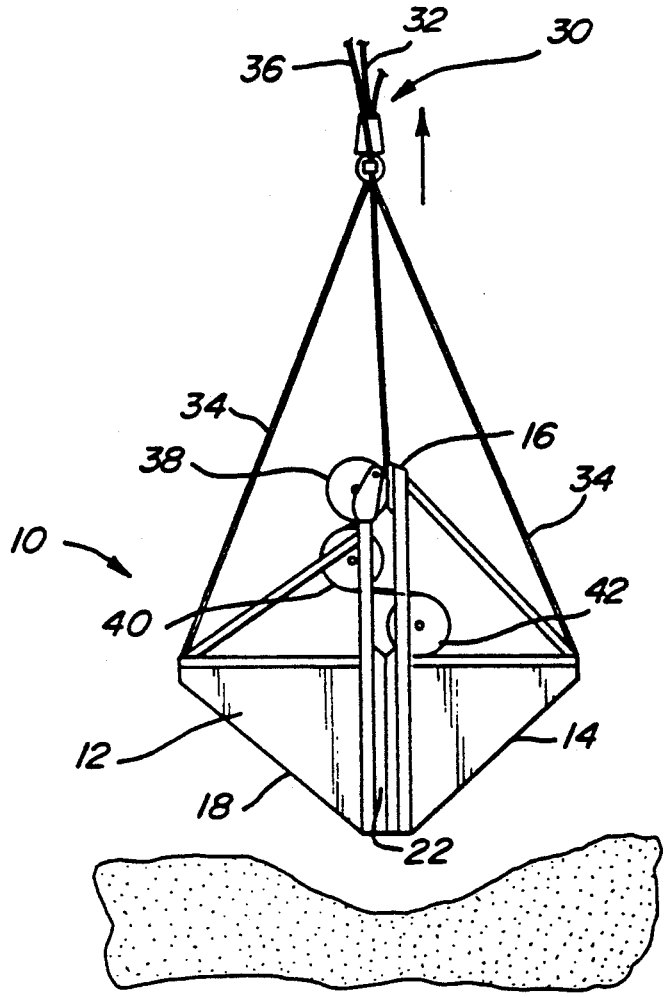
FIG. 1 is a side view illustrating a preferred embodiment of the present invention.
Figure 2:
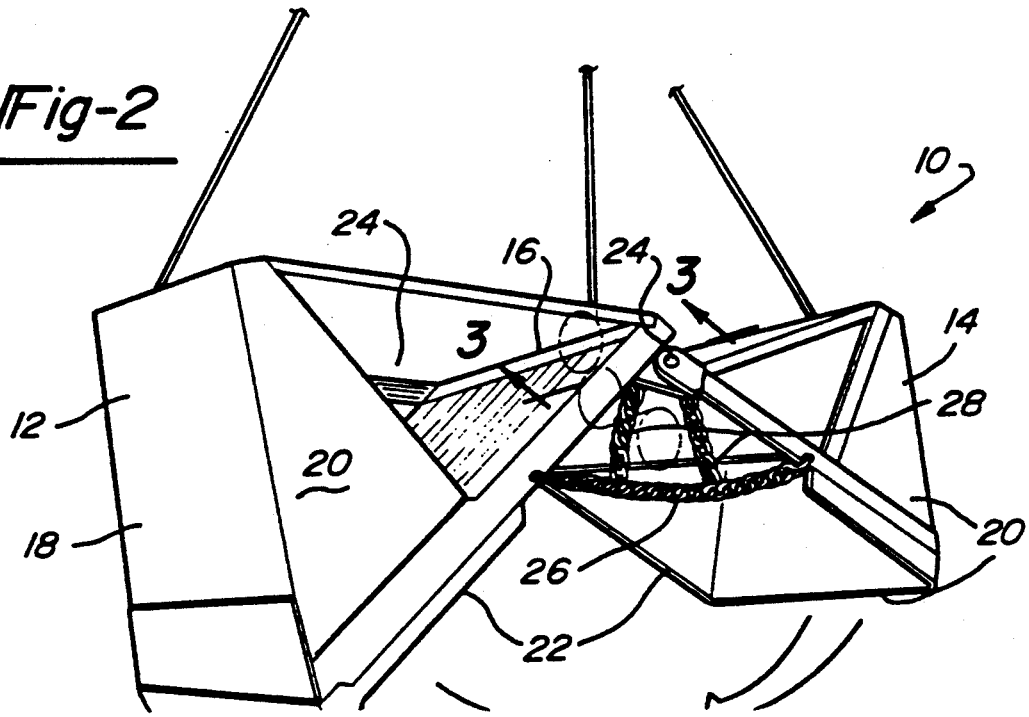
FIG. 2 is a view similar to FIG. 1, but showing the bucket in an open position.

With reference first to FIGS. 1 and 2, a preferred embodiment of the grab or bucket 10 of the present invention is thereshown and comprises a first bucket half 12 and a second bucket half 14.

Each bucket half 12 and 14 includes a top 16, closed bottom 18, spaced apart sidewalls 20 and an inside end 22. The bucket halves 12 and 14 are constructed from welded steel construction, rather than cast construction, thus reducing the weight of the bucket halves 12 and 14 without adversely affecting their structural integrity.

Figure 3A:
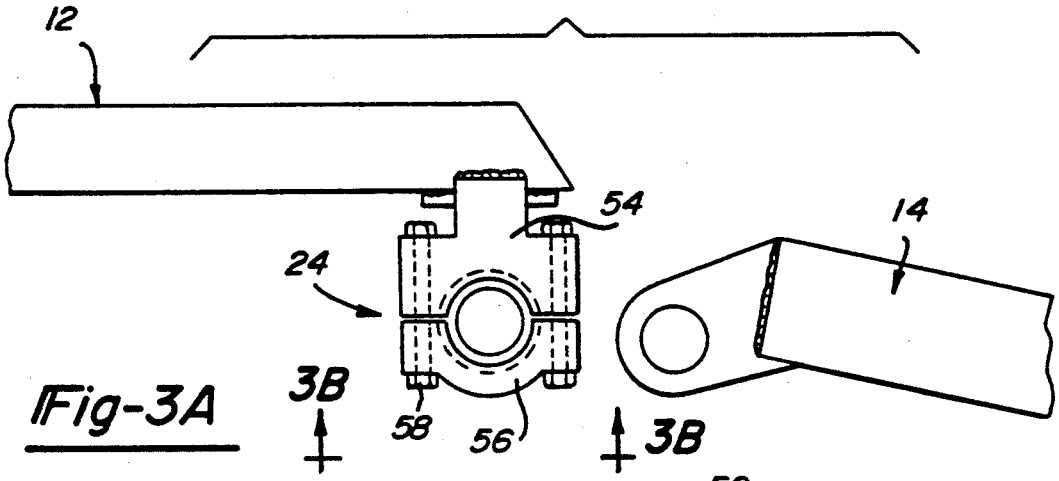
FIG. 3A is a side exploded view illustrating one trunnion.
Figure 3B:
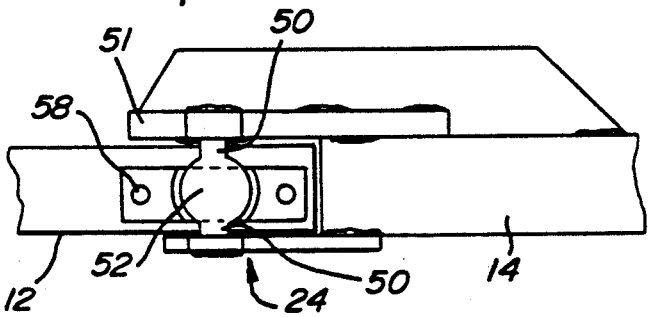
FIG. 3B is a view taken along line 3B—3B in FIG. 3A.

With reference now to FIGS. 2 and 3, a pair of spaced apart trunnions 24 are used to pivotally secure the top 16 of the bucket halves 12 and 14 together. As best shown in FIG. 3, each trunnion 24 includes stub axles 50 secured to a yoke 51 of one bucket half 12 and a ball 52 secured between the stub axles 50. This ball 52, in turn, is removably secured within a spherical recess member 54 by a cap 56 and bolts 58. The spherical recess member 54 is secured to the top 16 of the other bucket half 14. Consequently, the bucket halves 12 and 14 are movable between an open position, illustrated in FIG. 2, and a closed position, illustrated in FIG. 1.

The use of the trunnions 24 to pivotally secure the bucket halves 12 and 14 together are advantageous in several different respects. First, the trunnions 24 automatically compensate for slight misalignment of the bucket halves 12 and 14 unlike the previously known pivot shafts. Furthermore, the trunnions 24 permit the bucket halves 12 and 14 to be readily assembled and disassembled from each other.

As best shown in FIG. 2, at least one, and preferably two chains 26 extend between the bucket halves 12 and 14. These chains 26 limit the maximum opening of the bucket halves 12 and 14 and thus reduce strain and stress on the trunnions 24. Additionally, at least one and preferably two hanger chains 28 attach the chain 26 to the top 16 of the bucket halves 12 and 14 so that the chains 26 are held free of cargo contained within the power bucket 10.

Figure 4:
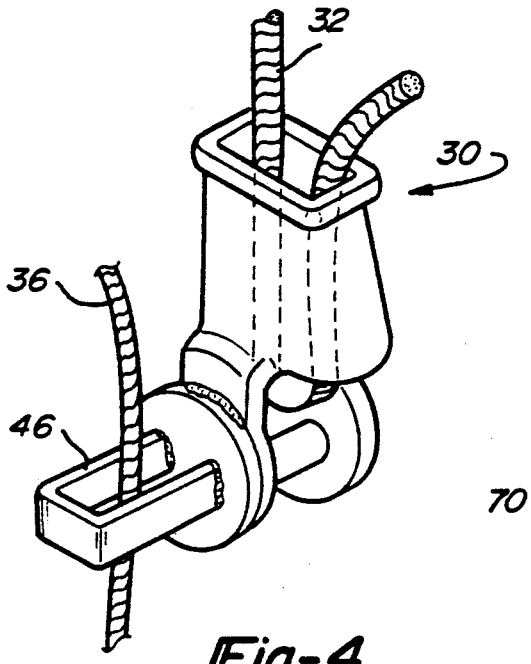
FIG. 4 is an enlarged view illustrating one component of the preferred embodiment of the present invention.

Referring now to FIGS. 1 and 4, a head 30 is disposed above the bucket halves 12 and 14 and is fixedly secured to the lifting cable 32 for the power shovel by any conventional means. At least one suspension cable or chain 34 extends between the head 30 and an outer end of each bucket half 12 and 14. Thus, the cable 32 raises and lowers the bucket halves 12 and 14 in unison with the head 30.

In order to move the bucket halves 12 and 14 between their open and closed position (FIG. 1), a closure cable 36 extends around pulleys 38 and 40 rotatably mounted to the bucket half 12, a pulley 42 rotatably mounted to the other bucket half 14 and a free end of the closure cable 36 which is tied or fixed to the bucket half 12. Thus, movement of the closure cable 36 relative to the head 30 pivots the bucket halves 12 and 14 via the trunnions 24 between an open and a closed position.

In the preferred embodiment of the invention, each of the pulleys 38, 40 and 42 comprises an oil filled and sealed pulley. Such pulleys enjoy a long and maintenance free life.

As best shown in FIG. 4, in order to prevent swinging of the closure cable, the closure cable 36 extends through a guide loop 46 attached to the head 30. The guide loop 46 permits the closure cable 36 to freely slidably extend through the guide loop 46 and yet prevents swinging of the closure cable 36 relative to the head 30.

Figure 5:
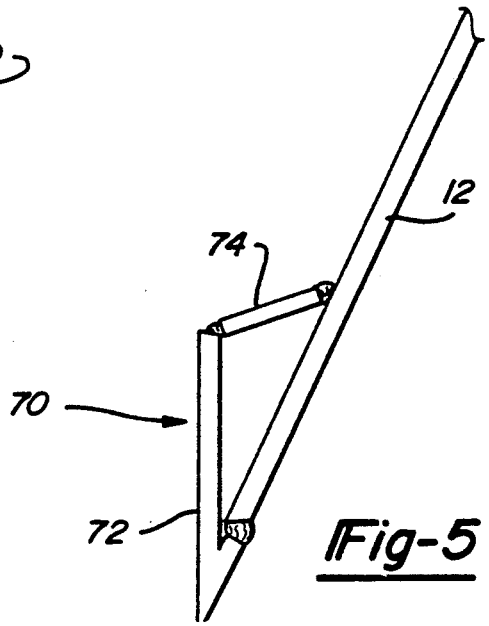
FIG. 5 is an enlarged view illustrating a further component of the present invention.

As best shown in FIG. 5, each cutting edge 70 of each bucket half 12 and 14 is formed by welding two plates 72 and 74 together to form a triangular configuration with its associated bucket half 12 or 14. This advantageously increases the strength of the cutting edge 70 while minimizing its costs.

From the foregoing, it can be seen that the present invention provides a bucket or grab which is relatively inexpensive in cost, and yet fully effective in operation.

Advantages of the present invention include not only the use of the welded steel construction, but also the head 30 disposed above the bucket halves 12 and 14 and connected to the bucket halves 12 and 14 by the chains 34. This not only decreases the overall weight of the bucket 10 with respect to the previously known cast clam shell buckets, but does so without any sacrifice in performance.

Other advantages of the present invention include the use of trunnions 24 for pivotally securing the bucket halves 12 and 14 together as well as the oil filled pulleys 38, 40 and 42. Furthermore, the simple construction for the head 30, including the closure cable guide loop 46, not only simplifies the construction for the bucket 10, but also maintains the cost for the bucket 10 at a minimum.

Having described my invention, however, many modifications thereto will become apparent to those skilled in the art to which it pertains without deviation from the spirit of the invention as defined by the scope of the appended claims.

I claim:

1. A bucket for loading and unloading cargo comprising:

a first bucket half and a second bucket half, each bucket having a top, a closed bottom, an open inside end and a pair of spaced apart sidewalls, means for pivotally securing the tops of said bucket halves together so that the bucket halves are movable between an open and a closed position, wherein in said closed position, said open ends of said bucket halves register with each other to contain cargo within an interior of said bucket and wherein in said open position, said open ends of said bucket halves are spaced apart from each other, wherein said pivotal securing means comprises a pair of spaced apart balls secured to said first bucket half, a spherical recess member secured to the second bucket half, each spherical recess member adapted to receive one of said balls, and means for removably securing said balls to their respective spherical recess member, a head, means for suspending said bucket halves from said head, means for moving said bucket halves between said open and said closed position.

2. The invention as defined in claim 1 wherein said suspending means comprises at least one cable extending between said head and each bucket half.

3. The invention as defined in claim 1 wherein said moving means comprises at least one pulley rotatably mounted to one of said bucket halves and a closure cable wound around said pulley and tied to the other bucket half.

4. The invention as defined in claim 3 wherein said head comprises a guide loop and wherein said closure cable slidably extends through said guide loop.

5. The invention as defined in claim 1 and comprising means for limiting the open position of said bucket.

6. The invention as defined in claim 5 wherein said limiting means comprises a chain extending between said bucket halves.

7. The invention as defined in claim 6 and comprising a hanger extending between a midpoint of said chain and a top of one bucket half, said hanger limiting the sagging of said chain when said bucket is in a closed position.

* * * * *